US007225806B2

(12) United States Patent
Mawhirt et al.

(10) Patent No.: US 7,225,806 B2
(45) Date of Patent: Jun. 5, 2007

(54) PORTABLE OXYGEN REGENERATING ESCAPE HOOD

(75) Inventors: James A. Mawhirt, Brooklyn, NY (US); Charles E. Toms, Colonia, NJ (US)

(73) Assignee: Jamcet Innovations, LLC, Colonia, NJ (US)

( * ) Notice: Subject to any disclaimer, the term of this patent is extended or adjusted under 35 U.S.C. 154(b) by 0 days.

(21) Appl. No.: 10/977,519

(22) Filed: Oct. 29, 2004

(65) Prior Publication Data

US 2006/0090756 A1 May 4, 2006

(51) Int. Cl.
*A62B 7/00* (2006.01)

(52) U.S. Cl. ..... 128/202.26; 128/205.12; 128/201.25

(58) Field of Classification Search ..... 128/202.26, 128/202.21, 201.25, 201.29, 20, 203.12, 128/203.16, 205.28, 206.25, 206.28, 206.12, 128/206.16, 202.25, 205.12; 2/171.2, 202, 2/173, 7–9, 171–174, 205, 206, 410, 424; 55/DIG. 33, DIG. 35

See application file for complete search history.

(56) References Cited

U.S. PATENT DOCUMENTS

| | | | | | |
|---|---|---|---|---|---|
| 1,686,592 | A * | 10/1928 | Wood | ..... | 128/202.26 |
| 4,020,833 | A * | 5/1977 | Rind | ..... | 128/202.26 |
| 4,231,118 | A * | 11/1980 | Nakagawa | ..... | 2/7 |
| 4,589,408 | A * | 5/1986 | Singer | ..... | 128/857 |
| 4,870,959 | A * | 10/1989 | Reisman et al. | ..... | 128/201.25 |
| 5,003,973 | A * | 4/1991 | Ford et al. | ..... | 128/201.25 |
| 5,181,506 | A * | 1/1993 | Tardiff et al. | ..... | 128/201.22 |
| 5,222,479 | A * | 6/1993 | Brauer et al. | ..... | 128/202.26 |
| 5,495,847 | A * | 3/1996 | Hu | ..... | 128/202.26 |
| 5,690,099 | A * | 11/1997 | Abramov et al. | ..... | 128/202.26 |
| 5,875,775 | A * | 3/1999 | Nur et al. | ..... | 128/201.28 |
| 5,884,336 | A * | 3/1999 | Stout | ..... | 2/206 |
| 6,543,450 | B1 * | 4/2003 | Flynn | ..... | 128/206.19 |

* cited by examiner

*Primary Examiner*—Justine R. Yu
*Assistant Examiner*—Shumaya Ali
(74) *Attorney, Agent, or Firm*—Plevy, Howard & Darcy PC

(57) ABSTRACT

A protective device to be emplaced over the head of a user comprises a sack-like member fabricated from a flexible film material and having an opening to enable a user to place the sack-like member over the user's head. The sack-like member has an interior containing a predetermined amount of an oxygen producing material, wherein the material produces oxygen by reacting with the exhalation products of the user.

15 Claims, 2 Drawing Sheets

PORTABLE OXYGEN REGENERATING ESCAPE HOOD

FIELD OF INVENTION

The present invention relates to protective devices in general and more particularly to a hood for covering the head of a user for protection from a hostile environment.

BACKGROUND

Smoke inhalation is a leading cause of death in fires, and recent world events have increased concern regarding the use of biological and chemical warfare in potential terrorist attacks. It is imperative that protective equipment be used to shield oneself against such events. Yet, despite these risks, very few Americans possess gas masks, since gas masks are generally expensive, non-compact, and need to be properly donned to obtain an air-tight fit. Further, such masks are primarily filters, providing virtually no protection in an oxygen-deficient environment. Accordingly, it would be particularly desirable to provide a protective device which would enable a user to quickly utilize the device during an emergency while providing a user with uncontaminated air for a relatively short period of time.

SUMMARY OF THE INVENTION

A protective device to be deployed and emplaced over the head of a user comprises a sack-like member fabricated from a flexible film material and having an opening to enable a user to place the sack-like member over the user's head. The sack-like member has an interior containing a predetermined amount of an oxygen producing material, wherein the material produces oxygen by reacting with the exhalation products of the user.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts, and wherein.

DETAILED DESCRIPTION

Figure 1:
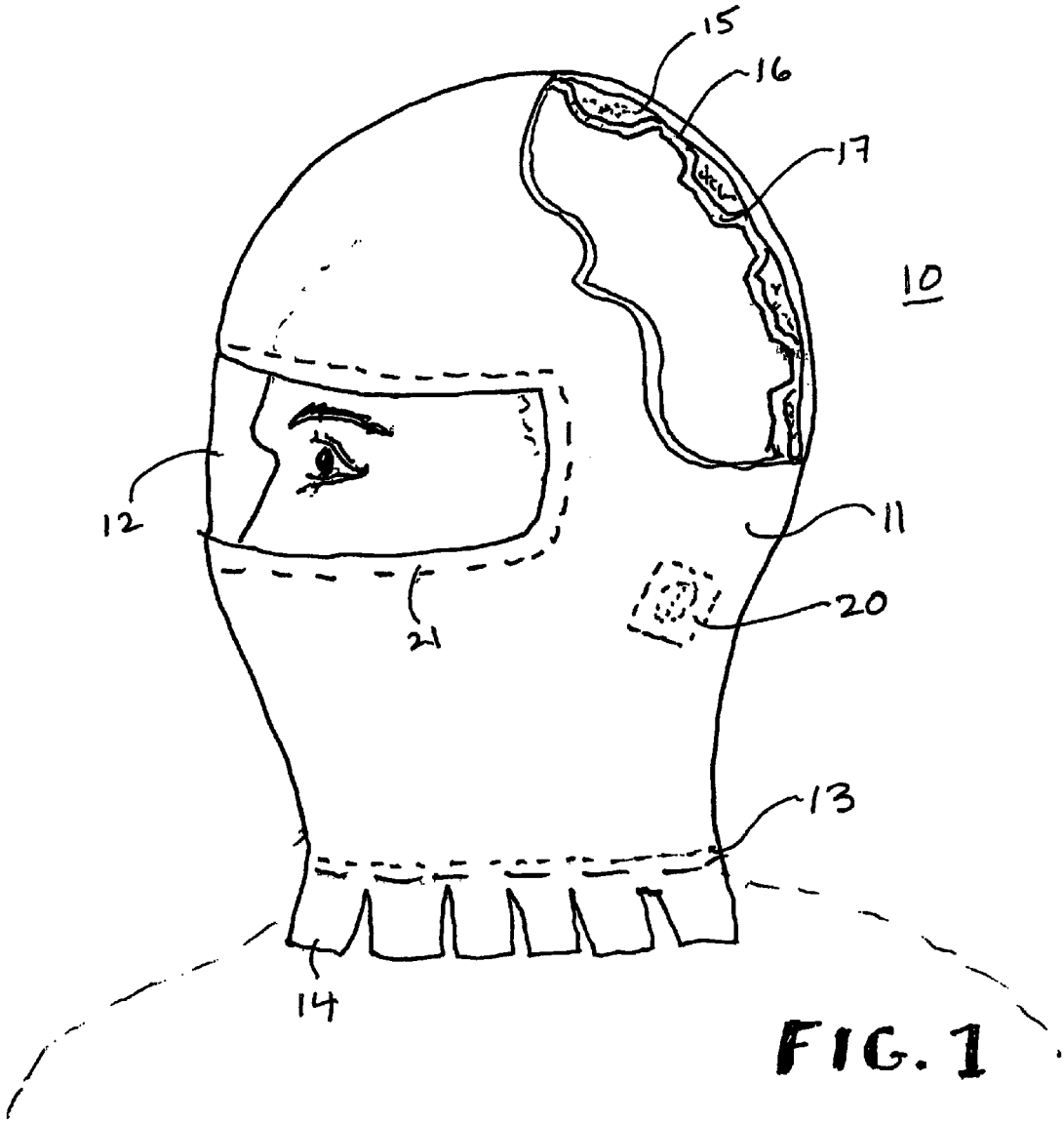
FIG. 1 is a perspective view of a portable oxygen regenerating escape hood according to an embodiment of the present invention.

It is to be understood that the figures and descriptions of the present invention have been simplified to illustrate elements that are relevant for a clear understanding, while eliminating, for the purpose of clarity, many other elements found in protective devices and methods of making and using the same. Those of ordinary skill in the art may recognize that other elements and/or steps may be desirable in implementing the present invention. However, because such elements and steps are well known in the art, and because they do not facilitate a better understanding of the present invention, a discussion of such elements and steps is not provided herein.

According to an aspect of the invention, a portable oxygen-regenerating escape hood (POE) device 10 is configured as a compact, wallet-sized apparatus, which can be used during an emergency, and which will provide the user with regenerated uncontaminated air for a short period of time (e.g., about fifteen minutes). In the case of a fire or terrorist attack, this device would offer respiratory protection against smoke, chemicals, or biological agents. Unlike gas masks, the device is compact and easy to use, so that individuals can carry it, and can use it without concern about obtaining a proper fit. The device 10 is adapted to be placed over the head of the user and secured thereto by means of an elastic band 13 which provides a tight seal about the neck of the user, thereby preventing any deleterious substances from entering the internal hollow of the hood. The device as embodied herein may be described as a hood, sack or bag like apparatus made of an outer surface 11 of a thin, heat resistant, non-permeable, flexible material, such as a layered plastic or polyester film, which may include metallized MYLAR® for example. In an exemplary configuration, the outer surface 11 is a heat-resistant, heat-reflective polyester (e.g. MYLAR) material. One can ascertain the use of the polyester enables one to be protected from heat. Further, the material is not permeable to other gases. A clear plastic or polyester window 12 is attached to the outer plastic enclosure 11 by thermally bonding thereto via thermal bond 21. This clear polyester window 12 enables a user to see and otherwise enable the individual to act and respond during an emergency condition.

The device comprises a plastic enclosure, lined with a reagent that will react with exhaled carbon dioxide to produce oxygen. In an exemplary configuration, the device's exterior is fabricated from metallized MYLAR (polyester), which is heat resistant, impermeable to gases and other contaminants, with a clear MYLAR window which allows for vision. The hood has an elastic neck opening, which forms an air-tight seal around the user's neck. The hood may be fabricated using a single cut sheet of polyester material, or may be made from multiple cut sheets and bonded together at the seams to form the exterior hood portion, for example.

The interior of the hood consists of numerous gas and water-permeable pouches 17, heat-sealed to the interior of the polyester or MYLAR material in a waffle-like pattern. This is clearly shown in the cross section of FIG. 1. The heat seal 16 enables the pouch to be firmly secured to the inner surface of the MYLAR 1. By way of non-limiting example, the gas and water-permeable pouches may be made of a flexible, durable material such as nylon, mesh or weave, perforated polycarbonate or cloth-like weave coated to permit heat sealing to the interior surface of the hood. The perforation or porosity size will contain the chemicals but allow for water vapor transmission. Each pouch 17 is of substantially the same configuration and the pouches contain a given amount of chemical reagent 15, such as potassium superoxide, which is used in some SCUBA equipment. Potassium superoxide contained in each of the pouches 17 reacts with water vapor emitted by the user's exhalation to produce potassium hydroxide and oxygen gas. Potassium hydroxide reacts with carbon dioxide to produce potassium carbonate. Besides producing oxygen, this two-step reaction eliminates toxic levels of carbon dioxide. The reaction is as follows and is indicated by the following equation.

Reaction:

Step 1: $4KO_2(s)+2H_2O(g)\rightarrow 4KOH(s)+3O_2(g)$

Step 2: $2KOH(s)+CO_2(g)\rightarrow K_2CO_3+H_2O(g)$

Combined: $4KO_2(s)+2CO_2(g)\rightarrow 2K_2CO_3+3O_2\ (g)$

As the chemical reaction shows, three oxygen molecules are produced for every two carbon dioxide molecules eliminated. While an exemplary embodiment has been described utilizing potassium superoxide, the present invention contemplates the use of any Group I or Group II metal oxides, including oxides of lithium, sodium, potassium, rubidium, cesium, francium, beryllium, magnesium, calcium, strontium, barium and radium, for example. To prevent overpressurization within the hood, a flap valve 20 allows excess pressure to escape. Since the valve opening is small, and the interior of the hood is hyperbaric when being used, gases will stream exit from the hood, but no contaminants will be able to enter. Advantageously, this dual acting valve allows outside air to enter once substantially all of the potassium superoxide has been converted to potassium carbonate and is evacuated. This prevents suffocation if the user wears the device beyond its recommended usage time. Based on the typical size of a person's head and the interior volume of the hood, one can utilize a sufficient quantity of a selected oxygen producing material such as potassium superoxide to provide oxygen for about fifteen to twenty minutes to enable the user to leave the contaminated or hostile area.

Figure 2:
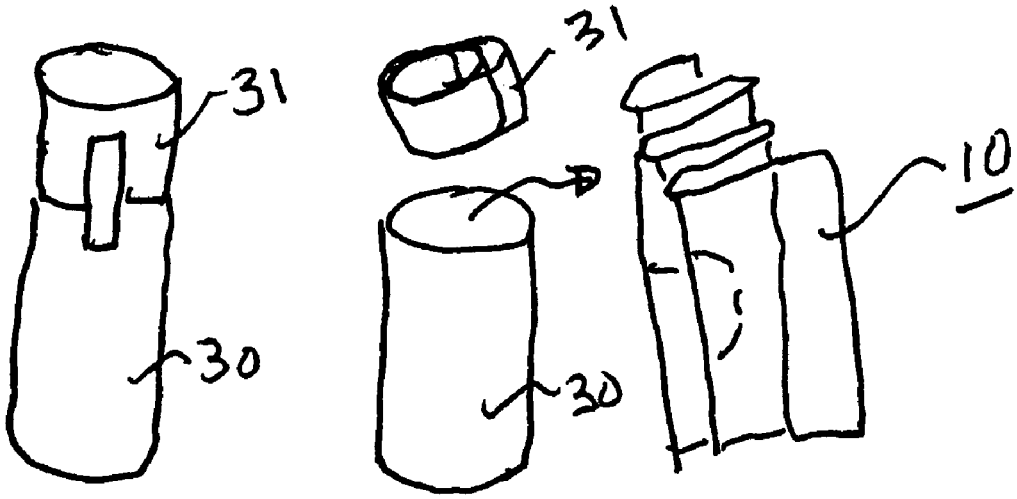
FIG. 2 depicts a pocket sized holder which can be employed to house the foldable hood depicted in FIG. 1.

Since the device's design is simple, comprising a few layers of plastic and a single reagent, the device will be inexpensive to manufacture and as shown in FIG. 2 can be contained in a compact carrying case 30 having a top opening portion 31 (e.g., pen-shaped), which a person could carry in their pocket, lunchbox, car or keep on a desk. The carrying case or container may be made of any durable material, such as plastic or metal, wherein the protective device may be stored for a prolonged period. As illustrated, the hood made out of plastic can be folded and placed in the interior portion of the pouch as depicted, thereby enabling a user-friendly respiratory-protective device that can be quickly deployed for providing heat protection and breathable air in a hostile environment.

As described herein, a protective device to be placed over the head of a user comprises a hood which is a bag like or sack-like structure which is accommodated to cover the head of the user. In one configuration, the device has an elastic band 13 which encircles the neck and provides a tight seal around the skirt 14. It is of course understood that other mechanisms can be utilized in lieu of band 13, such as a string-like mechanism where the user can adjust the tension of the strings and tie a bow after the device is in place. The outer surface is preferably made from a heat resistant, reflective metallized polyester. Such polyester is well known and utilized in a plurality of applications and is basically a reflective material. In this manner bacteria and chemicals will not be able to impinge into the interior of the polyester hood while heat and smoke will be reflected due to the reflective nature of the metallized polyester. Window 12 is a clear polyester material and thermally bonded to the hood, thereby providing protection to a user in hostile environments.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A protective device to be emplaced over the head of a user comprising:

a sack-like member fabricated from a gas-impermeable flexible film material and having an opening to enable a user to place the sack-like member over the user's head, said sack-like member having an interior wall containing a series of gas permeable pouches secured to the interior wall, wherein said pouches contain a predetermined amount of an oxygen producing material which produces oxygen by reacting with the exhalation products of said user.

2. The protective device according to claim 1 wherein said flexible film material comprises a metallized polyester film.

3. The protective device according to claim 2 wherein said flexible film material has a transparent portion to enable a user to see when said sack-like member is emplaced.

4. The protective device according to claim 2 wherein said film is metallized with a highly reflective metal effective to reflect at least one of heat and light.

5. The protective device according to claim 3 wherein said transparent portion is a window fabricated from a clear polyester film and bonded about an aperture located on said sack-like member and positioned to enable a user to view through said window.

6. The protective device according to claim 1 further comprising an elastic band positioned on said sack-like member near said opening to encircle said opening to enable a seal to be formed about the user's neck when said protective device is placed over the user's head.

7. The protective device according to claim 1 wherein said oxygen producing material is a Group I or Group II metal oxide.

8. The protective device according to claim 1 wherein said oxygen producing material is potassium superoxide.

9. The protective device according to claim 1 further comprising a bi-directional flap valve located on said sack-like member and operative to allow excess pressure to escape from the interior of said sack and to permit entry of surrounding atmosphere when said interior is evacuated.

10. The protective device according to claim 1, wherein said pouches contain potassium superoxide.

11. The protective device according to claim 10 wherein said pouches are fabricated from a porous material and are heat sealed to the interior wall of said sack-like member.

12. The protective device according to claim 11 wherein said porous material comprises a nylon material.

13. The protective device according to claim 11 wherein said porous material comprises one of a mesh, weave, and perforated polycarbonate material.

14. The protective device according to claim 1 further comprising a carrying case having an internal hollow for accommodating said sack-like member when said thin flexible material is folded.

15. The protective device according to claim 1, wherein said device defines a gas-impermeable sack-like member, and wherein said opening is the sole opening in said gas-impermeable sack-like member.

* * * * *